US007874383B1

(12) United States Patent
Cannon et al.

(10) Patent No.: US 7,874,383 B1
(45) Date of Patent: Jan. 25, 2011

(54) POLYCRYSTALLINE DIAMOND INSERT, DRILL BIT INCLUDING SAME, AND METHOD OF OPERATION

(75) Inventors: Randon S. Cannon, Springville, UT (US); Greg C. Topham, Spanish Fork, UT (US); Eric C. Pope, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 12/699,760

(22) Filed: Feb. 3, 2010

Related U.S. Application Data

(63) Continuation of application No. 11/333,969, filed on Jan. 17, 2006, now Pat. No. 7,681,669.

(60) Provisional application No. 60/644,664, filed on Jan. 17, 2005.

(51) Int. Cl.
*E21B 10/567* (2006.01)
*E21B 10/16* (2006.01)

(52) U.S. Cl. ..... 175/374; 175/434

(58) Field of Classification Search ..... 175/374, 175/425, 426, 434; 76/108.1, 108.2, 108.4
See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | DeLai |
| 3,233,988 | A | 2/1966 | Wentorf, Jr. |
| 3,745,623 | A | 7/1973 | Wentorf, Jr. |
| 4,108,614 | A | 8/1978 | Mitchell |
| 4,151,686 | A | 5/1979 | Lee et al. |
| 4,224,380 | A | 9/1980 | Bovenkerk et al. |
| 4,255,165 | A | 3/1981 | Dennis et al. |

(Continued)

FOREIGN PATENT DOCUMENTS

| | | |
|---|---|---|
| EP | 0300699 | 1/1989 |

(Continued)

OTHER PUBLICATIONS

Shuji Yatsu and Tetsuo Nakai, "Diamond Sintering and Processing Method", Japanese Unexamined Patent Application Publication 59-219500 Dec. 10, 1984, Japan.

(Continued)

*Primary Examiner*—Kenneth Thompson
(74) *Attorney, Agent, or Firm*—Holland & Hart, LLP

(57) ABSTRACT

Polycrystalline diamond inserts are disclosed. For example, a polycrystalline diamond insert may comprise a polycrystalline diamond layer affixed to a substrate at an interface. In addition the polycrystalline diamond layer may comprise: an arcuate exterior surface, a first region including a catalyst and a second region from which the catalyst is at least partially removed. Further, the arcuate exterior surface may be defined by a portion of the first region including the catalyst and a portion of the second region from which the catalyst is at least partially removed. In another embodiment, the polycrystalline diamond layer may include a convex exterior surface for contacting a subterranean formation, wherein at least a portion of a catalyst used for forming the polycrystalline diamond layer is removed from a region of the polycrystalline diamond layer. Subterranean drilling tools (e.g., percussive drill bits) including at least one polycrystalline diamond insert are disclosed.

17 Claims, 10 Drawing Sheets

U.S. PATENT DOCUMENTS

| | | | | |
|---|---|---|---|---|
| 4,268,276 | A | 5/1981 | Bovenkerk | |
| 4,303,442 | A | 12/1981 | Hara et al. | |
| 4,311,490 | A | 1/1982 | Bovenkerk et al. | |
| 4,373,593 | A | 2/1983 | Phaal et al. | |
| 4,387,287 | A | 6/1983 | Marazzi | |
| 4,412,980 | A | 11/1983 | Tsuji et al. | |
| 4,481,016 | A | 11/1984 | Campbell et al. | |
| 4,486,286 | A | 12/1984 | Lewin et al. | |
| 4,504,519 | A | 3/1985 | Zelez | |
| 4,522,633 | A | 6/1985 | Dyer | |
| 4,525,178 | A | 6/1985 | Hall | |
| 4,525,179 | A | 6/1985 | Gigl | |
| 4,534,773 | A | 8/1985 | Phaal et al. | |
| 4,556,403 | A | 12/1985 | Almond et al. | |
| 4,560,014 | A | 12/1985 | Geczy | |
| 4,570,726 | A | 2/1986 | Hall | |
| 4,572,722 | A | 2/1986 | Dyer | |
| 4,604,106 | A | 8/1986 | Hall et al. | |
| 4,605,343 | A | 8/1986 | Hibbs, Jr. et al. | |
| 4,606,738 | A | 8/1986 | Hayden | |
| 4,621,031 | A | 11/1986 | Scruggs | |
| 4,636,253 | A | 1/1987 | Nakai et al. | |
| 4,645,977 | A | 2/1987 | Kurokawa et al. | |
| 4,662,348 | A | 5/1987 | Hall et al. | |
| 4,664,705 | A | 5/1987 | Horton et al. | |
| 4,670,025 | A | 6/1987 | Pipkin | |
| 4,694,918 | A | 9/1987 | Hall | |
| 4,707,384 | A | 11/1987 | Schachner et al. | |
| 4,726,718 | A | 2/1988 | Meskin et al. | |
| 4,731,296 | A | 3/1988 | Kikuchi et al. | |
| 4,766,040 | A | 8/1988 | Hillert et al. | |
| 4,776,861 | A | 10/1988 | Frushour | |
| 4,784,023 | A | 11/1988 | Dennis | |
| 4,792,001 | A | 12/1988 | Zijsling | |
| 4,793,828 | A | 12/1988 | Burnand | |
| 4,797,241 | A | 1/1989 | Peterson et al. | |
| 4,802,539 | A | 2/1989 | Hall et al. | |
| 4,807,402 | A | 2/1989 | Rai | |
| 4,828,582 | A | 5/1989 | Frushour | |
| 4,844,185 | A | 7/1989 | Newton, Jr. et al. | |
| 4,861,350 | A | 8/1989 | Phaal et al. | |
| 4,871,377 | A | 10/1989 | Frushour | |
| 4,899,922 | A | 2/1990 | Slutz et al. | |
| 4,919,220 | A | 4/1990 | Fuller et al. | |
| 4,940,180 | A | 7/1990 | Martell | |
| 4,943,488 | A | 7/1990 | Sung et al. | |
| 4,944,772 | A | 7/1990 | Cho | |
| 4,976,324 | A | 12/1990 | Tibbets | |
| 5,027,912 | A | 7/1991 | Juergens | |
| 5,030,276 | A | 7/1991 | Sung et al. | |
| 5,092,687 | A | 3/1992 | Hall | |
| 5,116,568 | A | 5/1992 | Sung et al. | |
| 5,127,923 | A | 7/1992 | Bunting et al. | |
| 5,135,061 | A | 8/1992 | Newton, Jr. | |
| 5,154,245 | A | 10/1992 | Waldenstrom et al. | |
| 5,176,720 | A | 1/1993 | Martell et al. | |
| 5,186,725 | A | 2/1993 | Martell et al. | |
| 5,199,832 | A | 4/1993 | Meskin et al. | |
| 5,205,684 | A | 4/1993 | Meskin et al. | |
| 5,213,248 | A | 5/1993 | Horton et al. | |
| 5,238,074 | A | 8/1993 | Tibbets | |
| 5,264,283 | A | 11/1993 | Waldenstrom | |
| 5,304,342 | A | 4/1994 | Hall, Jr. et al. | |
| 5,335,738 | A | 8/1994 | Waldenstrom et al. | |
| 5,337,844 | A | 8/1994 | Tibbets | |
| 5,370,195 | A | 12/1994 | Keshavan et al. | |
| 5,379,835 | A | 1/1995 | Sterich | |
| 5,437,343 | A * | 8/1995 | Cooley et al. | 175/431 |
| 5,439,492 | A | 8/1995 | Anthony et al. | |
| 5,464,068 | A | 11/1995 | Najafi-Sani | |
| 5,468,268 | A | 11/1995 | Tank et al. | |
| 5,496,638 | A | 3/1996 | Waldenstrom | |
| 5,505,748 | A | 4/1996 | Tank et al. | |
| 5,510,193 | A | 4/1996 | Cerutti et al. | |
| 5,523,121 | A | 6/1996 | Anthony et al. | |
| 5,524,719 | A | 6/1996 | Dennis | |
| 5,560,716 | A | 10/1996 | Tank et al. | |
| 5,607,024 | A | 3/1997 | Keith et al. | |
| 5,620,382 | A | 4/1997 | Cho et al. | |
| 5,624,068 | A | 4/1997 | Waldenstrom et al. | |
| 5,645,617 | A | 7/1997 | Frushour | |
| 5,667,028 | A | 9/1997 | Truax et al. | |
| 5,718,948 | A | 2/1998 | Ederyd et al. | |
| 5,722,499 | A | 3/1998 | Nguyen et al. | |
| 5,776,615 | A | 7/1998 | Wong et al. | |
| 5,833,021 | A | 11/1998 | Mensa-Wilmot et al. | |
| 5,871,060 | A | 2/1999 | Jensen et al. | |
| 5,897,942 | A | 4/1999 | Karner et al. | |
| 5,954,147 | A | 9/1999 | Overstreet | |
| 5,979,578 | A | 11/1999 | Packer | |
| 6,009,963 | A | 1/2000 | Chaves et al. | |
| 6,063,333 | A | 5/2000 | Dennis | |
| 6,063,502 | A | 5/2000 | Sue et al. | |
| 6,068,913 | A | 5/2000 | Cho et al. | |
| 6,106,957 | A | 8/2000 | Fang | |
| 6,123,612 | A | 9/2000 | Goers | |
| 6,126,741 | A | 10/2000 | Jones et al. | |
| 6,234,261 | B1 | 5/2001 | Evans et al. | |
| 6,248,447 | B1 | 6/2001 | Griffin et al. | |
| 6,269,894 | B1 | 8/2001 | Griffin et al. | |
| 6,290,726 | B1 | 9/2001 | Pope et al. | |
| 6,315,065 | B1 * | 11/2001 | Yong et al. | 175/428 |
| 6,344,149 | B1 | 2/2002 | Oles | |
| 6,361,873 | B1 | 3/2002 | Yong et al. | |
| 6,410,085 | B1 | 6/2002 | Griffin et al. | |
| 6,435,058 | B1 | 8/2002 | Matthias et al. | |
| 6,451,442 | B1 | 9/2002 | Sue et al. | |
| 6,454,027 | B1 | 9/2002 | Fang et al. | |
| 6,481,511 | B2 | 11/2002 | Matthias et al. | |
| 6,528,159 | B1 | 3/2003 | Kuroda et al. | |
| 6,544,308 | B2 | 4/2003 | Griffin et al. | |
| 6,562,462 | B2 | 5/2003 | Griffin et al. | |
| 6,585,064 | B2 | 7/2003 | Griffin et al. | |
| 6,589,640 | B2 | 7/2003 | Griffin et al. | |
| 6,592,985 | B2 | 7/2003 | Griffin et al. | |
| 6,601,662 | B2 | 8/2003 | Matthias et al. | |
| 6,607,835 | B2 | 8/2003 | Fang et al. | |
| 6,739,214 | B2 | 5/2004 | Griffin et al. | |
| 6,749,033 | B2 | 6/2004 | Griffin et al. | |
| 6,797,326 | B2 | 9/2004 | Griffin et al. | |
| 6,861,098 | B2 | 3/2005 | Griffin et al. | |
| 6,861,137 | B2 | 3/2005 | Griffin et al. | |
| 6,869,460 | B1 | 3/2005 | Bennett et al. | |
| 6,878,447 | B2 | 4/2005 | Griffin et al. | |
| 6,962,214 | B2 | 11/2005 | Hughes et al. | |
| 7,350,601 | B2 | 4/2008 | Belnap et al. | |
| 7,473,287 | B2 | 1/2009 | Belnap et al. | |
| 7,493,973 | B2 | 2/2009 | Keshavan et al. | |
| 7,517,589 | B2 | 4/2009 | Eyre | |
| 7,568,534 | B2 | 8/2009 | Griffin et al. | |
| 7,575,805 | B2 | 8/2009 | Achilles et al. | |
| 2005/0115744 | A1 | 6/2005 | Griffin et al. | |
| 2005/0129950 | A1 | 6/2005 | Griffin et al. | |
| 2005/0247486 | A1 | 11/2005 | Zhang et al. | |
| 2005/0263328 | A1 | 12/2005 | Middlemiss | |
| 2006/0060390 | A1 | 3/2006 | Eyre et al. | |
| 2006/0060391 | A1 | 3/2006 | Eyre et al. | |
| 2006/0086540 | A1 | 4/2006 | Griffin et al. | |
| 2006/0157286 | A1 | 7/2006 | Pope | |

| | | | |
|---|---|---|---|
| 2007/0039762 | A1 | 2/2007 | Achilles |
| 2007/0181348 | A1 | 8/2007 | Lancaster et al. |

FOREIGN PATENT DOCUMENTS

| | | |
|---|---|---|
| EP | 0329954 | 8/1989 |
| EP | 0196777 | 3/1991 |
| EP | 0500253 | 8/1992 |
| EP | 0595631 | 5/1994 |
| EP | 0595830 | 5/1994 |
| EP | 0612888 | 8/1994 |
| EP | 0617207 | 9/1994 |
| EP | 0787820 | 8/1997 |
| EP | 0595630 | 1/1998 |
| EP | 0612868 | 7/1998 |
| EP | 0860515 | 8/1998 |
| EP | 0860518 | 8/1998 |
| EP | 1190791 | 3/2002 |
| GB | 232398 | 4/1925 |
| GB | 1349385 | 4/1974 |
| GB | 2048927 | 12/1980 |
| GB | 2268768 | 1/1994 |
| GB | 2418215 | 3/2006 |
| GB | 2422394 | 7/2006 |
| JP | 5935066 | 2/1984 |
| JP | 59188492 | 10/1984 |
| JP | 61125739 | 6/1986 |
| JP | 61214496 | 9/1986 |
| JP | 62179839 | 8/1987 |
| JP | 05306428 | 11/1993 |
| JP | 0762468 | 3/1995 |
| JP | 11245103 | 9/1999 |
| JP | 2000087112 | 3/2000 |
| RU | 566439 | 1/2000 |
| SU | 2034937 | 5/1991 |
| WO | 9323204 | 11/1993 |
| WO | 9634131 | 10/1996 |
| WO | 0028106 | 5/2000 |
| WO | 2004040095 | 5/2004 |
| WO | 2004106003 | 12/2004 |
| WO | 2004106004 | 12/2004 |
| WO | 2005061181 | 7/2005 |

OTHER PUBLICATIONS

Unverified English Translation of Shuji Yatsu and Tetsuo Nakai, "Diamond Sintering and Processing Method", Japanese Unexamined Patent Application Publication 59-219500, Dec. 10, 1984, Japan.

Study on the Heat Deterioration Mechanism of Sintered Diamond Program & Abstracts of the 27th High Pressure Conference of Japan Oct. 13-15, 1986, Sapporo.

S. Hong, et al., "Dissolution Behavior of Fine Particles of Diamond Under High Pressure Sintering Conditions," Journal of Materials Science Letters 10, pp. 164-166 (1991).

* cited by examiner

POLYCRYSTALLINE DIAMOND INSERT, DRILL BIT INCLUDING SAME, AND METHOD OF OPERATION

CROSS-REFERENCE TO RELATED APPLICATION

This application claims the benefit of U.S. patent application Ser. No. 11/333,969 filed Jan. 17, 2006, which claims the benefit of U.S. Patent Application No. 60/644,664, filed 17 Jan. 2005, the disclosures of each of which are incorporated, in their entirety, by this reference.

BACKGROUND

Polycrystalline diamond compacts or inserts often form at least a portion of a cutting structure of a subterranean drilling or boring tools; including drill bits (fixed cutter drill bits, roller cone drill bits, etc.) reamers, and stabilizers. Such tools, as known in the art, may be used in exploration and production relative to the oil and gas industry. Polycrystalline diamond compacts or inserts may also be utilized as percussive inserts on percussion boring or drilling tools. A variety of polycrystalline diamond percussive compacts and inserts are known in the art.

A polycrystalline diamond compact ("PDC") typically includes a diamond layer or table formed by a sintering process employing high temperature and high pressure conditions that causes the diamond table to become is bonded or affixed to a substrate (such as cemented tungsten carbide substrate), as described in greater detail below. Optionally, the substrate may be brazed or otherwise joined to an attachment member such as a stud or to a cylindrical backing, if desired. A PDC may be employed as a subterranean cutting element mounted to a drill bit either by press-fitting, brazing, or otherwise coupling a stud to a recess defined by the drill bit, or by brazing the cutting element directly into a preformed pocket, socket, or other receptacle formed in the subterranean drill bit. In one example, cutter pockets may be formed in the face of a matrix-type bit comprising tungsten carbide particles that are infiltrated or cast with a binder (e.g., a copper-based binder), as known in the art. Such subterranean drill bits are typically used for rock drilling and for other operations which require high abrasion resistance or wear resistance. Generally, a rotary drill bit may include a plurality of polycrystalline abrasive cutting elements affixed to the drill bit body.

A PDC is normally fabricated by placing a cemented carbide substrate into a container or cartridge with a layer of diamond crystals or grains positioned adjacent one surface of a substrate. A number of such cartridges may be typically loaded into an ultra-high pressure press. The substrates and adjacent diamond crystal layers are then sintered under ultra-high temperature and ultra-high pressure ("HPHT") conditions. The ultra-high pressure and ultra-high temperature conditions cause the diamond crystals or grains to bond to one another to form polycrystalline. In addition, as known in the art, a catalyst may be employed for facilitating formation of polycrystalline diamond. In one example, a so-called "solvent catalyst" may be employed for facilitating the formation of polycrystalline diamond. For example, cobalt, nickel, and iron are among examples of solvent catalysts for forming polycrystalline diamond. In one configuration, during sintering, solvent catalyst comprising the substrate body (e.g., cobalt from a cobalt-cemented tungsten carbide substrate) becomes liquid and sweeps from the region adjacent to the diamond powder and into the diamond grains. Of course, a solvent catalyst may be mixed with the diamond powder prior to sintering, if desired. Also, as known in the art, such a solvent catalyst may dissolve carbon. Such carbon may be dissolved from the diamond grains or portions of the diamond grains that graphitize due to the high temperatures of sintering. When the solvent catalyst is cooled, the carbon held in solution may precipitate or otherwise be expelled from the solvent catalyst and may facilitate formation of diamond bonds between abutting or adjacent diamond grains. Thus, diamond grains become mutually bonded to form a polycrystalline diamond table upon the substrate. The solvent catalyst may remain in the polycrystalline diamond layer within the interstitial pores between the diamond grains. A conventional process for forming polycrystalline diamond cutters, is disclosed in U.S. Pat. No. 3,745,623 to Wentorf, Jr. et al., the disclosure of which is incorporated, in its entirety, by reference herein. Optionally, another material may replace the solvent catalyst that has been at least partially removed from the polycrystalline diamond.

Diamond enhanced inserts are frequently used as the cutting structure on drill bits to bore through geological formations. It is not unusual that diamond enhanced inserts are subjected to conditions down hole that exceed the mechanical properties of the insert and failures occur. One factor believed to contribute to such failures is a thermal mechanical breakdown of the polycrystalline diamond structure. In percussive drilling applications, the high frequency of relatively high load impact and rotary actions can generate high temperatures on the tip (contact area) of the polycrystalline diamond inserts. Further, one of ordinary skill in the art will understand that temperatures experienced on a polycrystalline diamond of any drilling tool may be higher than expected or desired.

A percussive bit, also known as a hammer bit, penetrates a subterranean formation through a combination of percussive and rotary interactions with the subterranean formation. A downhole hammer actuates the bit in a vertical direction so that intermittent impacting with the formation, which may pulverize at least a portion of the subterranean formation, may occur. The rotary action may generally be driven by a so-called "top drive" and may facilitate complete excavation of the bottom hole. The inserts on a hammer bit are generally hemispherical or conical in shape. A hemispherical geometry may provide the necessary toughness for a typically brittle polycrystalline diamond material. A variety of polycrystalline diamond insert designs to improve the life of percussive insert are well known in the art. Inventions such as transition layers, non-planar interfaces, composite diamond mixes and non-continuous diamond surfaces are all designed to improve the toughness and overall life of a percussive diamond insert.

The polycrystalline diamond layer generally comprises diamond. However, other materials are often exist due to the nature of manufacturing polycrystalline diamond ("PCD"). More particularly, PCD manufacturing generally requires the presence of a catalyst/solvent metal to enhance formation of diamond to diamond bonding to occur. These catalyst/solvent metal may include metals such as cobalt, nickel or iron. During the sintering process a skeleton or matrix of diamond is formed through diamond-to-diamond bonding between adjacent diamond particles. Further, relatively small pore spaces or interstitial spaces may be formed within the diamond structure, which may be filled with catalyst/solvent metal. Because the solvent/catalyst exhibits a much higher thermal expansion coefficient than the diamond structure, the presence of such catalyst/solvent within the diamond structure is believed to be a factor leading to premature thermal mechanical damage.

Accordingly, as the PCD reaches temperatures exceeding 400° Celsius, the differences in thermal expansion coefficients between the diamond the catalyst may cause diamond bonds to fail. Of course, as the temperature increases, such thermal mechanical damage may be increased. In addition, as the temperature of the PCD layer approaches 750° Celsius, a different thermal mechanical damage mechanism initiates. At approximately 750° Celsius or greater, the catalyst metal begins to chemically react with the diamond causing graphitization of the diamond. This phenomenon may be termed "back conversion," meaning conversion of diamond to graphite. Such conversion from diamond to graphite causes dramatic loss of wear resistance in a polycrystalline diamond compact and may rapidly lead to insert failure.

Concerning percussive drilling, polycrystalline diamond percussive inserts may be more susceptible to degradation associated with increased temperatures than diamond cutting structures utilized on other earth boring tools (e.g., fixed cutter bits (PDC bits, roller cone bits (TRI-CONE®, etc.). Explaining further, percussive drilling may employ air, foam or mist as a coolant. However, none of such coolants transfers the heat away from the insert tip. Other drilling methods may utilize oil or water-based drilling fluids (e.g., muds) that may be more effective in cooling the diamond structure.

Thus, it would be advantageous to provide a polycrystalline diamond compact or insert with enhanced thermal stability. In addition, subterranean drill bits or tools for forming a borehole in a subterranean formation including at least one such percussive polycrystalline diamond insert may be beneficial.

SUMMARY

The present invention relates generally to a polycrystalline diamond insert comprising a polycrystalline diamond layer or table formed or otherwise bonded or affixed to a substrate. In one embodiment, a substrate may comprise cemented tungsten carbide. Further, at least a portion of a catalyst used for forming the polycrystalline diamond layer or table may be at least partially removed from at least a portion of the polycrystalline diamond layer or table. Any of the polycrystalline diamond inserts encompassed by this disclosure may be employed in a drilling tool for forming a borehole in a subterranean formation (e.g., a percussive tool for forming a borehole in a subterranean formation) of any known type.

One aspect of the present invention relates to a polycrystalline diamond insert. More particularly, a polycrystalline diamond insert may comprise a polycrystalline diamond layer bonded or affixed to a substrate at an interface. In addition, the polycrystalline diamond layer may comprise: an arcuate exterior surface, a first region including a catalyst used for forming the polycrystalline diamond layer, and a second region from which the catalyst is at least partially removed. Further, the arcuate exterior surface may be defined by a portion of the first region including the catalyst and a portion of the second region from which the catalyst is at least partially removed. In one example, a boundary layer between the first region and the second region may be substantially planar.

Another aspect of the present invention relates to a polycrystalline diamond insert. Particularly, a polycrystalline diamond insert may comprise a polycrystalline diamond layer bonded or affixed to a substrate at an interface. More specifically, the polycrystalline diamond layer may include a convex exterior surface for contacting a subterranean formation, wherein at least a portion of a catalyst used for forming the polycrystalline diamond layer is removed from a region of the polycrystalline diamond layer.

In one embodiment, a rotary drill bit used to form a borehole in a subterranean formation may comprise a bit body comprising a leading end structured for facilitating forming a borehole in a subterranean formation by percussive interaction with the subterranean formation. In further detail, at least one polycrystalline diamond insert may be coupled to the leading end of the bit body, wherein the at least one polycrystalline diamond insert comprises: a polycrystalline diamond layer bonded or affixed to a substrate. Further, the polycrystalline diamond layer may include a convex exterior surface for contacting a subterranean formation, wherein at least a portion of a catalyst used for forming the polycrystalline diamond layer is removed from a region of the polycrystalline diamond layer.

Features from any of the above mentioned embodiments may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

Further features of the subject matter of the instant disclosure, its nature, and various advantages will be more apparent from the following detailed description and the accompanying drawings, which illustrate various exemplary embodiments, are representations, and are not necessarily drawn to scale, wherein.

DETAILED DESCRIPTION

The present invention relates generally to an insert comprising a polycrystalline diamond layer or mass bonded or affixed to a substrate. As described above, a polycrystalline diamond layer may be formed upon and bonded to a substrate by HPHT sintering. Further, a catalyst (e.g., cobalt, nickel, iron, or any group VIII element, as denoted on the periodic chart, or any catalyst otherwise known in the art) used for forming the polycrystalline diamond layer may be at least partially removed from the polycrystalline diamond layer.

Relative to polycrystalline diamond, as known in the art, during sintering of polycrystalline diamond, a catalyst material (e.g., cobalt, nickel, etc.) may be employed for facilitating formation of polycrystalline diamond. More particularly, as known in the art, diamond powder placed adjacent to a cobalt-cemented tungsten carbide substrate and subjected to a HPHT sintering process may wick or sweep molten cobalt into the diamond powder which may remain in the polycrystalline diamond table upon sintering and cooling. In other embodiments, catalyst may be provided within the diamond powder, as a layer of material between the substrate and diamond powder, or as otherwise known in the art. As also known in the art, such a catalyst material may be at least partially removed (e.g., by acid-leaching or as otherwise known in the art) from at least a portion of the volume of polycrystalline diamond (e.g., a table) formed upon the substrate. In one embodiment, catalyst removal may be substantially complete to a selected depth from an exterior surface of the polycrystalline diamond table, if desired, without limitation. Such catalyst removal may provide a polycrystalline diamond material with increased thermal stability, which may also beneficially affect the wear resistance of the polycrystalline diamond material. Thus, the present invention contemplates that any polycrystalline diamond insert discussed in this application may comprise polycrystalline diamond from which at least a portion of a catalyst used for forming the polycrystalline diamond is removed. One of ordinary skill in the art will understand that complete removal of the catalyst from a polycrystalline diamond layer may be difficult, if not impossible, without damage to the integrity of the polycrystalline diamond layer, because at least some catalyst may be isolated (i.e., completely surrounded) by polycrystalline diamond.

Figure 1:
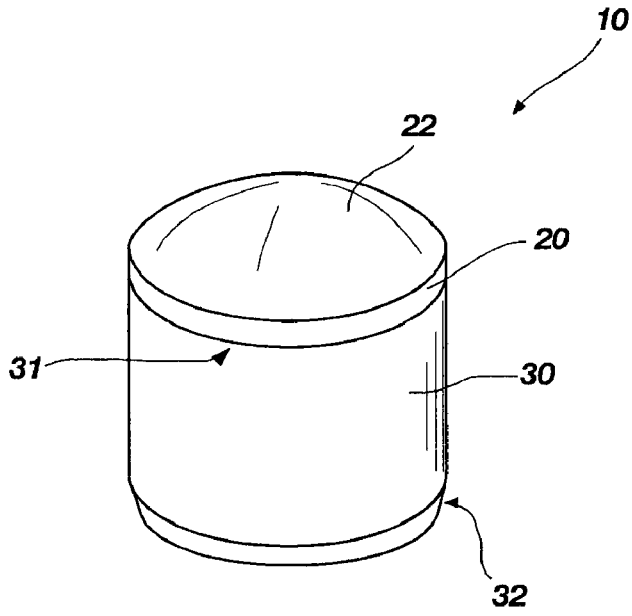
FIG. 1 shows a perspective view of a polycrystalline diamond insert according to the present invention.

In one embodiment, an insert may comprise a polycrystalline diamond layer including an arcuate exterior surface for contacting a subterranean formation. For example, FIG. 1 shows a perspective view of a polycrystalline diamond insert 10 including a polycrystalline diamond layer 20 (or table) formed upon a substrate 30 along an interface surface 31. In further detail, polycrystalline diamond layer 20 may comprise an arcuate exterior surface 22. Generally, in one embodiment, the arcuate exterior surface 22 may be convex. Optionally, arcuate exterior surface 22 may be substantially spherical (e.g., at least a portion of a sphere, for example, substantially hemispherical, without limitation), in one embodiment. As discussed above, polycrystalline diamond layer 20 may be formed upon substrate 30 by way of a HPHT process. In addition, a catalyst may be used to facilitate formation of polycrystalline diamond layer 20. The present invention contemplates that such a catalyst may be at least partially removed from polycrystalline diamond layer 20.

Figure 2:
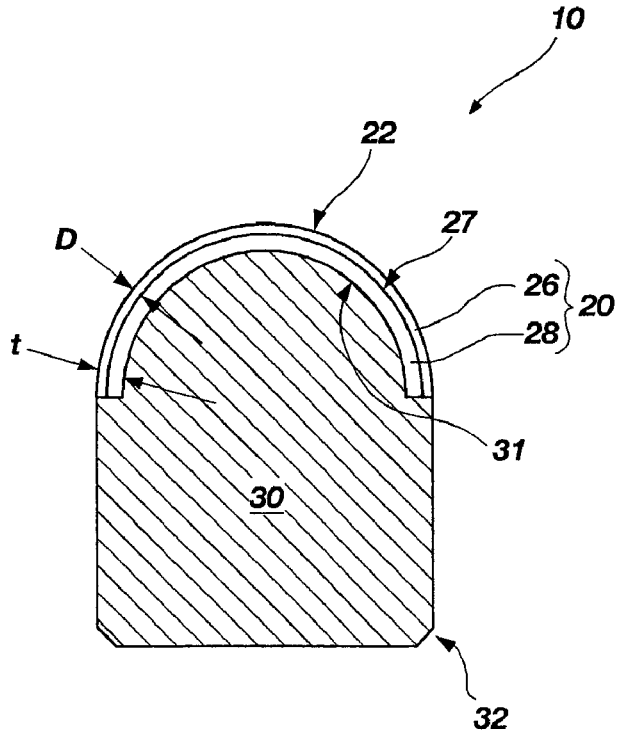
FIG. 2 shows a schematic side cross-sectional view of one embodiment of a polycrystalline diamond insert according to the present invention.

In one embodiment, a catalyst may be at least partially removed from polycrystalline diamond layer 20 so that a boundary surface between a catalyst containing portion of polycrystalline diamond layer 20 and a portion of the polycrystalline diamond from which catalyst is at least partially removed is formed. Further, optionally, such a boundary surface may substantially follow or be substantially congruous with the arcuate exterior surface 22 of the polycrystalline diamond layer 20. For example, FIG. 2 shows a schematic, partial side and side cross-sectional view of one embodiment of polycrystalline diamond insert 10. In further detail, FIG. 2 shows polycrystalline diamond layer 20 formed upon substrate 30. As shown in FIG. 2, in one embodiment, polycrystalline diamond layer 20 may have a substantially uniform thickness t (e.g., measured between arcuate exterior surface 22 and interface surface 31). Put another way, arcuate exterior surface 22 and interface surface 31 may be substantially congruous or complimentary. For example, both arcuate exterior surface 22 and interface surface 31 may be substantially spherical and may exhibit a substantially equal radius. Further, in one embodiment, substrate 30 may comprise cemented tungsten carbide. Also, in one embodiment, substrate 30 may be generally cylindrical and may include a relief feature 32 (e.g., a chamfer or radius) that removes a sharp peripheral edge (e.g., a circumferential edge) that may be otherwise formed upon substrate 30. As discussed in greater detail below, a portion of substrate 30 may be press-fit or brazed into a recess of an apparatus for use in contacting another body (e.g., a subterranean formation).

Also, as shown in FIG. 2, polycrystalline diamond layer 20 may comprise a region 28 that includes a catalyst employed for forming polycrystalline diamond layer 20 and a region 26 from which such catalyst has been at least partially removed. At least partial removal of a catalyst may be achieved by acid-leaching or as otherwise known in the art, without limitation. In further detail, region 26 and region 28 may meet or abut along a boundary surface 27. In one embodiment, boundary surface 27 may be arcuate. For example, in one embodiment, boundary surface 27 may be substantially spherical. Further, as one of ordinary skill in the art will appreciate with respect to FIG. 2, boundary surface 27, in one embodiment, may be substantially hemispherical. In other embodiments, boundary surface 27 may be elliptical, ovoid, domed, or otherwise arcuate or convex, without limitation. Further, if the boundary surface 27 is substantially congruous with the exterior surface 22 of the polycrystalline diamond layer 20, depth D may be substantially uniform (i.e., a distance into diamond layer 20 from arcuate exterior surface 22 in a direction substantially perpendicular to a tangent plane at a selected point upon arcuate exterior surface 22).

Figure 3:
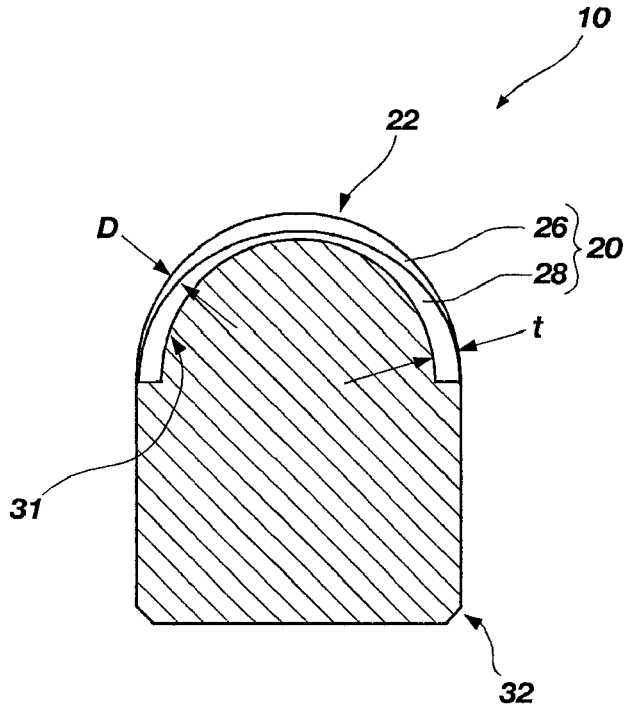
FIG. 3 shows a schematic side cross-sectional view of another embodiment of a polycrystalline diamond insert according to the present invention.

In addition, the present invention further contemplates that various boundary surfaces may be formed between a first region of a polycrystalline diamond layer including catalyst and a second region of a polycrystalline diamond layer from which at least a portion of the catalyst has been removed. In addition, a depth to the boundary surface may vary in relation to a selected position upon arcuate exterior surface 22 of polycrystalline diamond layer 20. For instance, FIG. 3 shows a schematic, side cross-sectional view of another embodiment of a polycrystalline diamond insert 10. Generally, the polycrystalline diamond insert 10 shown in FIG. 3 may be as described above in relation to FIG. 2. However, as shown in FIG. 3, a depth D of boundary surface 27 (forming region 26 from which catalyst is at least partially removed) varies across the arcuate surface 22 of polycrystalline diamond layer 20. In one embodiment, both arcuate exterior surface 22 and boundary surface 27 may be substantially spherical and may have different radii.

Figure 4:
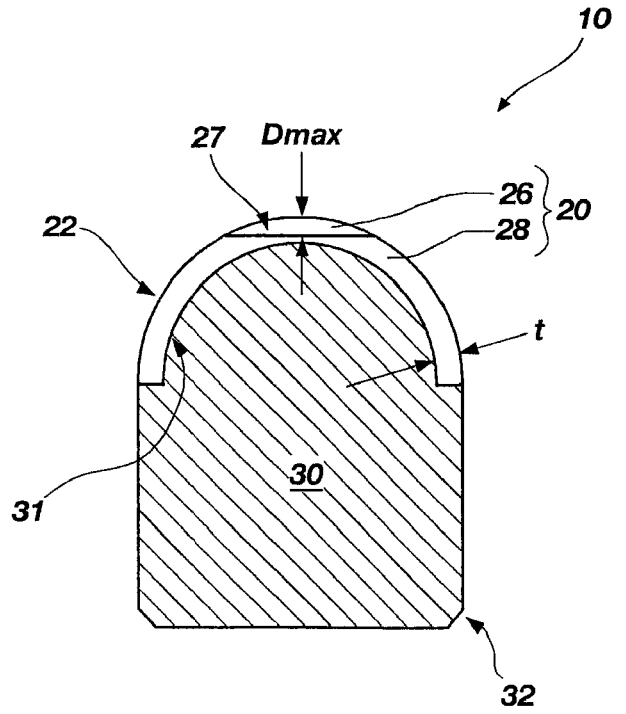
FIG. 4 shows a schematic side cross-sectional view of a further embodiment of a polycrystalline diamond insert according to the present invention.

In a further embodiment, a boundary surface between a region of a polycrystalline diamond layer including catalyst and a region of the polycrystalline diamond layer from which at least a portion of the catalyst has been removed may be at least generally planar. For example, FIG. 4 shows a schematic, side cross-sectional view of a further embodiment of a polycrystalline diamond insert 10 including a polycrystalline diamond layer 20 formed upon a substrate 30, the polycrystalline diamond layer 20 comprising an arcuate exterior surface 22. Further, polycrystalline diamond layer 20 may comprise a first region 28 that includes a catalyst employed for forming polycrystalline diamond layer 20 and a second region 26 from which such catalyst has been at least partially removed. In further detail, region 26 and region 28 may meet or abut along a boundary surface 27, wherein boundary surface 27 is substantially planar. For example, in one embodiment, boundary surface 27 may be substantially planar and may be positioned at a maximum depth $D_{max}$ (measured from an apex of arcuate exterior surface 27 of polycrystalline diamond layer 20), as shown in FIG. 4. Thus, region 26, in one embodiment, may form a spherical cap (i.e., a region of a sphere which lies above or below selected plane). Such a boundary surface 27 (and associated region 26 from which a catalyst is at least partially removed) may be formed by immersing (e.g., dipping or otherwise initiating contact between) a selected region of the polycrystalline diamond layer 20 and a liquid that is formulated to remove at least a portion of the catalyst. In one embodiment, the catalyst may be substantially completely removed form region 26. For example, as mentioned above, an acid may be used to leach at least a portion of the catalyst from a selected region of polycrystalline diamond layer 20. The present invention further contemplates that electrolytic or electroless chemical processes, or any other processes known in the art, without limitation, may be employed for removing at least a portion of a catalyst from a selected region of a polycrystalline diamond layer 20.

Figure 5:
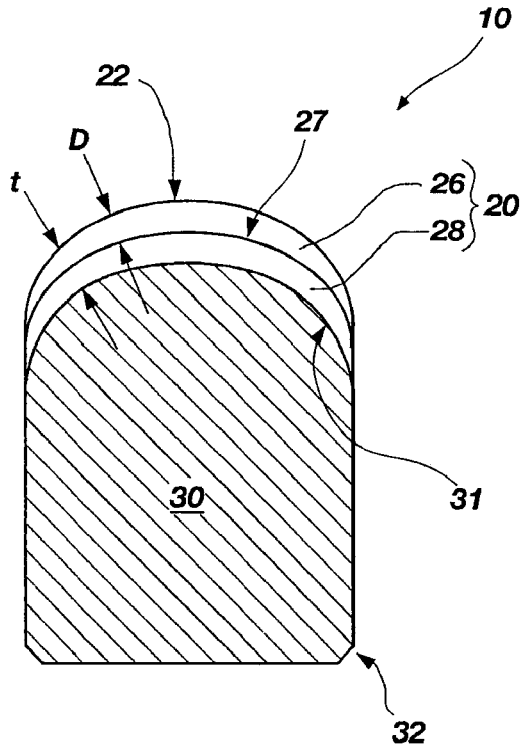
FIG. 5 shows a schematic side cross-sectional view of an additional embodiment of a polycrystalline diamond insert according to the present invention.

In other embodiments, a polycrystalline diamond layer may exhibit a varying thickness. For example, FIG. 5 shows a schematic, side cross-sectional view of yet an additional embodiment of a polycrystalline diamond insert 10 including a polycrystalline diamond layer 20 bonded or affixed to a substrate 30 along an interface surface 31, wherein the polycrystalline diamond layer 20 exhibits a varying thickness t. In further detail, as shown in FIG. 5, boundary surface 27 may exhibit a varying depth D. Thus, in one embodiment, region 26 may have a shape defined between a substantially spherical arcuate exterior surface 22 and a substantially spherical boundary surface 27. As described above, at least partially removing a catalyst from region 26 may be accomplished by, for example, chemical interaction between an acid and a catalyst (e.g., cobalt).

Figure 6:
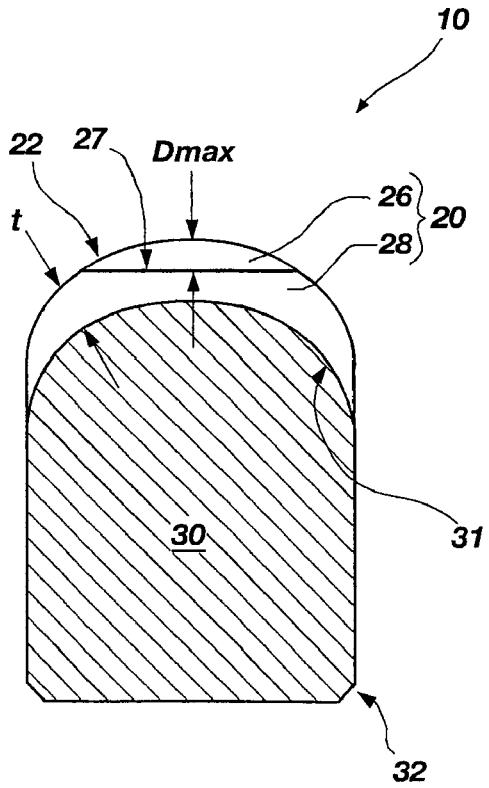
FIG. 6 shows a schematic side cross-sectional view of yet a further embodiment of a polycrystalline diamond insert according to the present invention.

In a further embodiment, a polycrystalline diamond layer may exhibit a varying thickness and a substantially planar boundary layer may be formed between a region of a polycrystalline diamond layer including catalyst and a region from which the catalyst is at least partially removed. FIG. 6 shows a schematic, side cross-sectional view of one embodiment of a polycrystalline diamond insert 10 including a polycrystalline diamond layer 20 bonded or affixed to a substrate 30 along an interface surface 31. Further, as shown in FIG. 6, polycrystalline diamond layer may comprise a region 28, which includes a catalyst (e.g., cobalt or other catalyst known in the art) and a region 26 from which the catalyst employed for forming polycrystalline diamond layer 20 is at least partially removed (subsequent to formation of polycrystalline diamond layer 20). In further detail, region 26 and region 28 may meet or abut along a substantially planar boundary surface 27, wherein boundary surface 27 is positioned at a maximum depth $D_{max}$ (measured from an apex of arcuate exterior surface 27 of polycrystalline diamond layer 20), as shown in FIG. 6. Thus, if arcuate exterior surface 22 of polycrystalline diamond layer 20 is substantially spherical, region 26, in one embodiment, may form a spherical cap.

Figure 7:
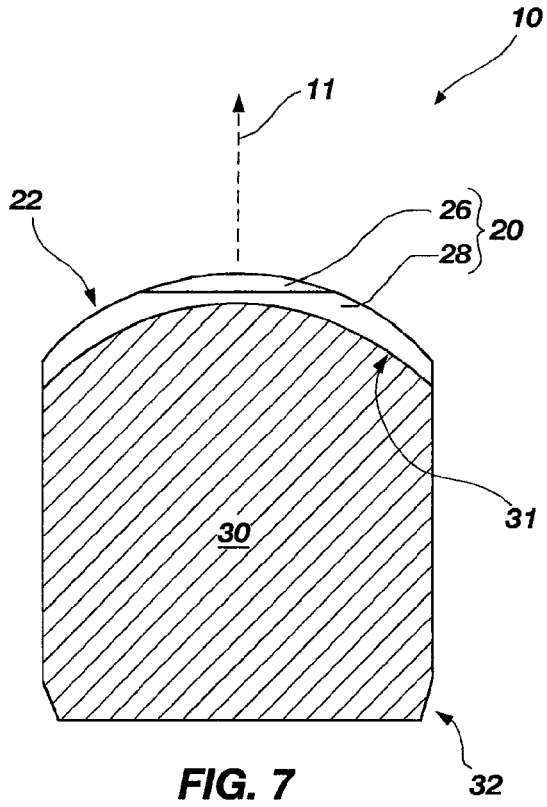
FIG. 7 shows a schematic side cross-sectional view of yet an additional embodiment of a polycrystalline diamond insert according to the present invention.

FIG. 7 shows a schematic, side cross-sectional view of another embodiment of a polycrystalline diamond insert 10 including a polycrystalline diamond layer 20 bonded to a substrate 30 along interface surface 31. As shown in FIG. 7, arcuate exterior surface 22 may form a relatively shallow dome. Put another way, an included angle forming the arcuate curve defining a cross section of arcuate exterior surface 22 may be less than about 120 degrees. Further, optionally, region 26 and region 28 may meet or abut along a substantially planar boundary surface 27, wherein boundary surface 27 is oriented substantially perpendicular to a central axis 11 of polycrystalline diamond insert 10, as shown in FIG. 6. Thus, if arcuate exterior surface 22 of polycrystalline diamond layer 20 is substantially spherical, region 26, in one embodiment, may form a spherical cap.

Figure 8:
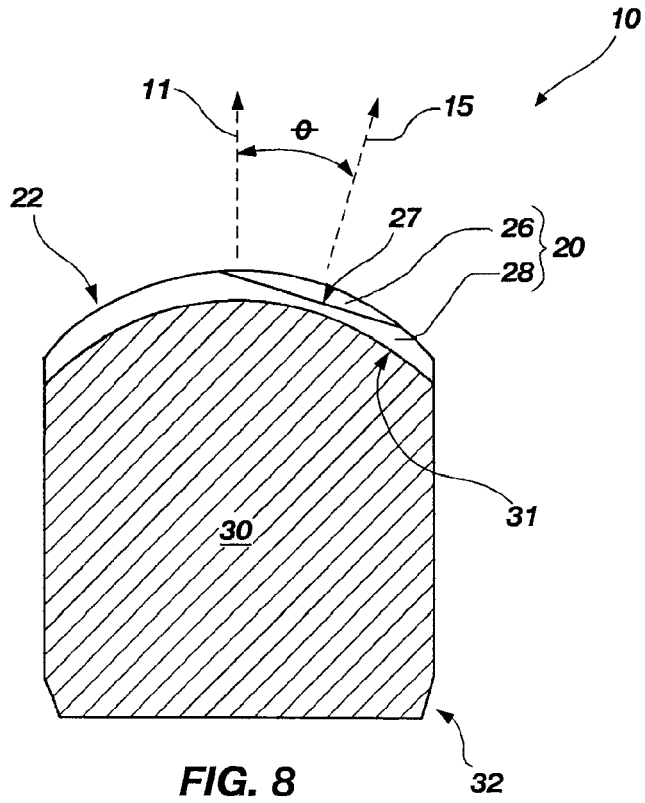
FIG. 8 shows a schematic side cross-sectional view of yet another exemplary embodiment of a polycrystalline diamond insert according to the present invention.
Figure 9:
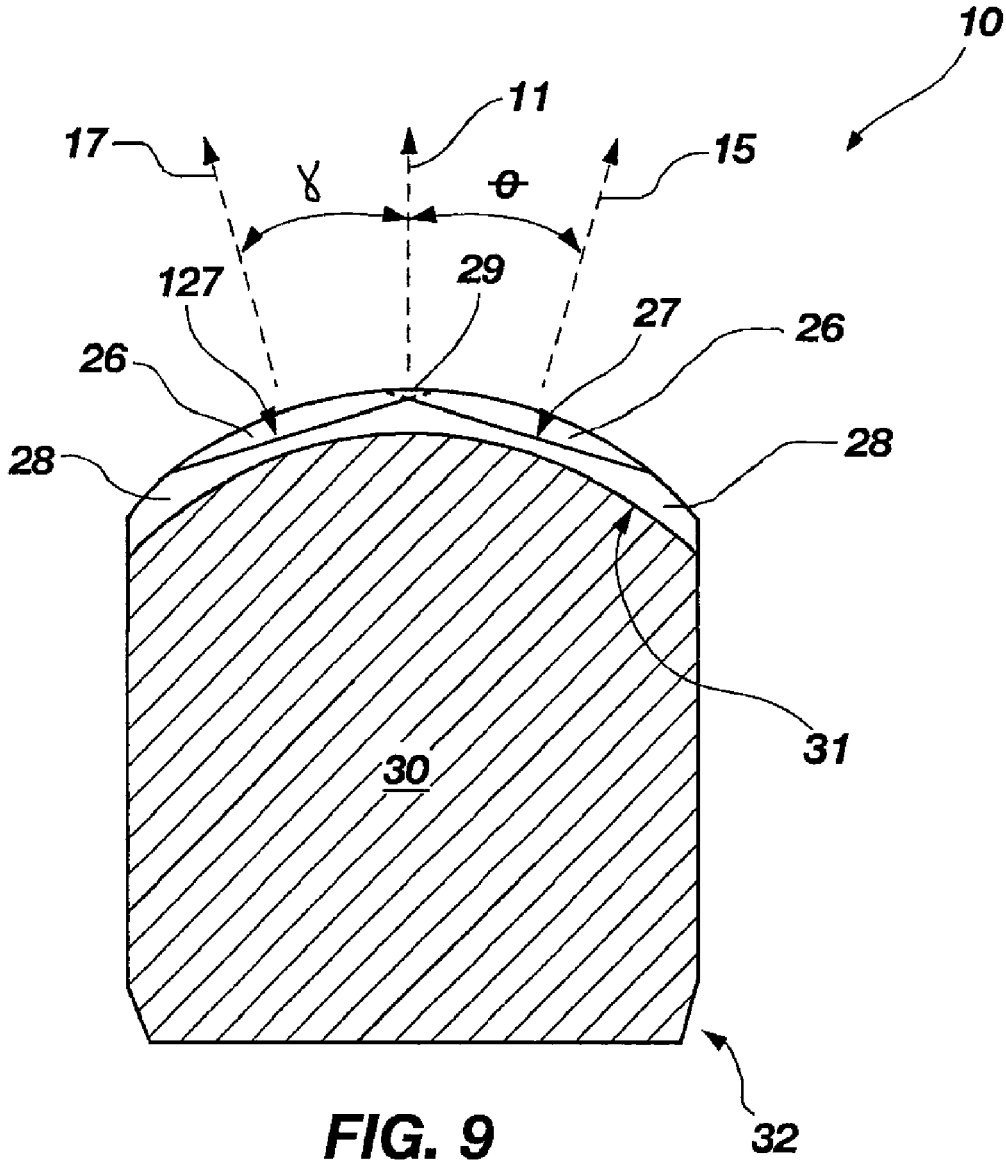
FIG. 9 shows a schematic side cross-sectional view of a further exemplary embodiment of a polycrystalline diamond insert according to the present invention.

In another embodiment, a substantially planar boundary surface between a region including catalyst and a region from which catalyst is at least partially removed may be oriented at a selected angle relative to a central axis of a polycrystalline diamond insert. For example, FIG. 8 shows a schematic, side cross-sectional view of one embodiment of a polycrystalline diamond insert 10 including a polycrystalline diamond layer 20 bonded or affixed to a substrate 30 along an interface surface 31. Further, as shown in FIG. 8, region 26 and region 28 may meet or abut along a substantially planar boundary surface 27, wherein an axis 15 that is substantially perpendicular to boundary surface 27 is oriented at a selected angle θ with respect to central axis 11 of polycrystalline diamond insert 10. Thus, if arcuate exterior surface 22 of polycrystalline diamond layer 20 is substantially spherical, region 26, in one embodiment, may form a spherical cap. As mentioned above, such a substantially planar boundary surface 27 (and associated region 26 from which a catalyst is at least partially removed) may be formed by immersing (e.g., dipping, spraying, or otherwise initiating contact between) a selected region of the polycrystalline diamond layer 20 and a liquid (e.g., an acid or other solvent for the catalyst) that is formulated to remove at least a portion of the catalyst. Orienting boundary surface 27 at a selected angle θ with respect to central axis 11 may cause region 26 to be formed within a selected portion of the polycrystalline diamond layer 20. One of ordinary skill in the art will appreciate that the size and orientation of a substantially planar boundary region may be More generally, the present invention contemplates that at least one substantially planar boundary region may be formed by removing at least a portion of catalyst from a selected region of a polycrystalline diamond layer. Thus, in one embodiment, a plurality of substantially planar boundary surfaces may be formed. For example, FIG. 9 shows a schematic, side cross-sectional view of one embodiment of a polycrystalline diamond insert 10 including a polycrystalline diamond layer 20 bonded or affixed to a substrate 30 along an interface surface 31 including two substantially planar boundary surfaces 27 and 127. As shown in FIG. 9, region 26 and region 28 may be formed along a substantially planar boundary surfaces 27 and 127. In addition, axis 15, which is substantially perpendicular to boundary surface 27 may be oriented at a selected angle θ with respect to central axis 11 of polycrystalline diamond insert 10. Further, axis 17, which is substantially perpendicular to boundary surface 127 may be oriented at a selected angle γ with respect to central axis 11 of polycrystalline diamond insert 10. Region 26 also comprises overlapping region 29, which is noted to illustrate that a portion of polycrystalline diamond layer 20 may be treated or processed to remove at least a portion of a catalyst employed for forming polycrystalline diamond layer 20 more than once. Thus, overlapping region 29 may be exposed to a treatment (e.g., acid leaching) to remove at least a portion of a catalyst repeatedly. Such repeated treatments may result in substantially complete removal of the catalyst. One of ordinary skill in the art will appreciate that substantially planar boundary surfaces 27 and 127 may be formed by immersing (e.g., dipping, spraying, or otherwise initiating contact between) a first selected region of the polycrystalline diamond layer 20 and a liquid (e.g., an acid or other solvent for the catalyst) and subsequently immersing (e.g., dipping, spraying, or otherwise initiating contact between) a second selected region of the polycrystalline diamond layer 20 and a liquid (e.g., an acid or other solvent for the catalyst).

Figure 10:
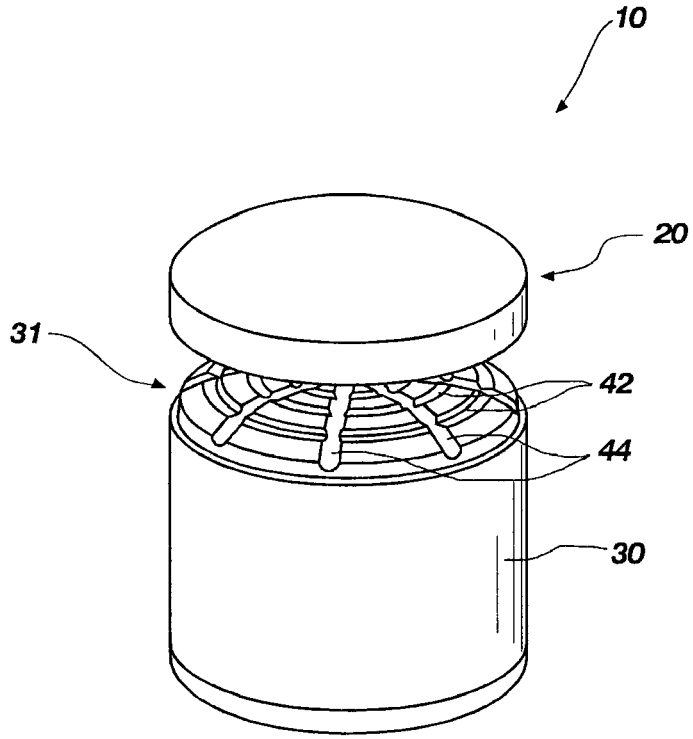
FIG. 10 shows an exploded perspective view of a further embodiment of a superabrasive insert according to the present invention.

The present invention also contemplates that an interface between a substrate and a polycrystalline diamond layer may include one or more groove. For example, FIG. 10 shows an exploded view of a polycrystalline diamond insert 10 including a polycrystalline diamond layer 20 bonded or affixed to a substrate 30 over a generally domed interface 31. As shown in FIG. 10, domed interface 31 may include one or more circumferentially extending grooves 42 and/or one or more radially extending grooves 44. As known in the art, such grooves 42 and/or 44 may each exhibit selected dimensions (e.g., depth, width, shape, etc.). Such a configuration may improve the integrity or strength of the bond between the polycrystalline diamond layer 20 and the substrate 30. As mentioned above, an interfacial surface between a polycrystalline diamond layer and a substrate may generally mimic or follow an exterior surface of the polycrystalline diamond layer, if desired. In summary, generally substantially planar and generally nonplanar interface geometries may further include, without limitation, non-planar features including protrusions, grooves, and depressions. Such nonplanar features may enhance an attachment strength of the polycrystalline diamond table to the substrate.

Figure 11:
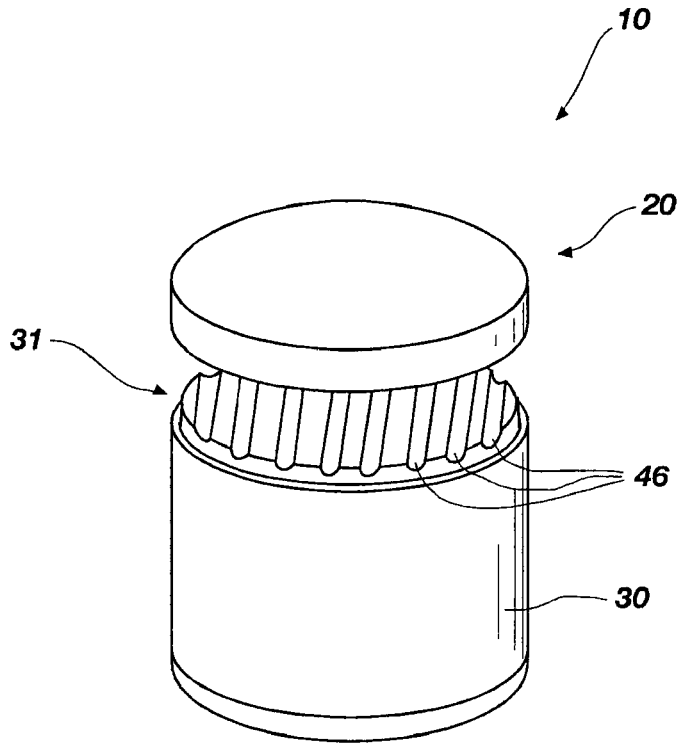
FIG. 11 shows an exploded perspective view of an additional embodiment of a superabrasive insert according to the present invention.

In a further embodiment, a plurality of substantially linear or substantially straight grooves may form an interface between a polycrystalline diamond layer and a substrate. For example, FIG. 11 shows an exploded view of a polycrystalline diamond insert 10 including a polycrystalline diamond layer 20 bonded or affixed to a substrate 30 over a generally planar interface 31. As shown in FIG. 11, substrate 30 may include one or more grooves 46, which may, optionally, be substantially parallel to one another. As known in the art, such grooves 46 may each exhibit selected dimensions (e.g., depth, width, shape, etc.). Such a configuration may improve the integrity or strength of the bond between the polycrystalline diamond layer 20 and the substrate 30. Of course, such grooves 46 may be formed upon a domed or otherwise arcuate topography, without limitation. Such nonplanar features may enhance an attachment strength of the polycrystalline diamond layer 20 to the substrate 30 or may provide a desired geometry to the polycrystalline diamond layer 20, the substrate 30, or both.

The present invention further contemplates that at least one polycrystalline diamond insert may be installed upon a subterranean drill bit or other drilling tool for forming a borehole in a subterranean formation known in the art. For example, in one embodiment, at least one polycrystalline diamond insert may be affixed to a percussive drill bit, also known as a percussion bit. As known in the art, a percussion bit may include tungsten carbide inserts, polycrystalline diamond inserts, or a mixture of tungsten carbide and polycrystalline diamond inserts. During use, a percussion bit may be rotated and intermittently impacted (i.e., forced against) axially against a subterranean formation so that contact between the inserts and the subterranean formation causes a portion of the subterranean formation to be removed.

Figure 12:
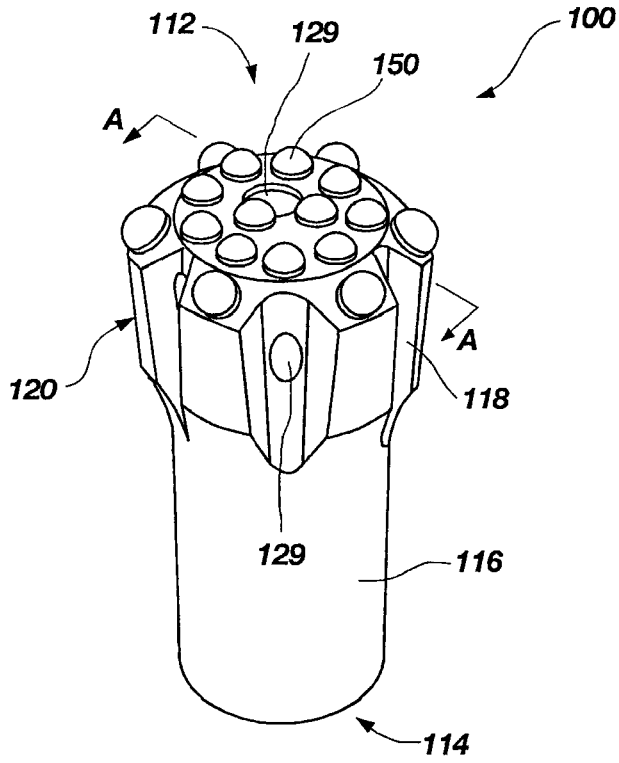
FIG. 12 shows a perspective view of one embodiment of a percussive subterranean drill bit including at least one polycrystalline diamond insert according to the present invention.
Figure 13:
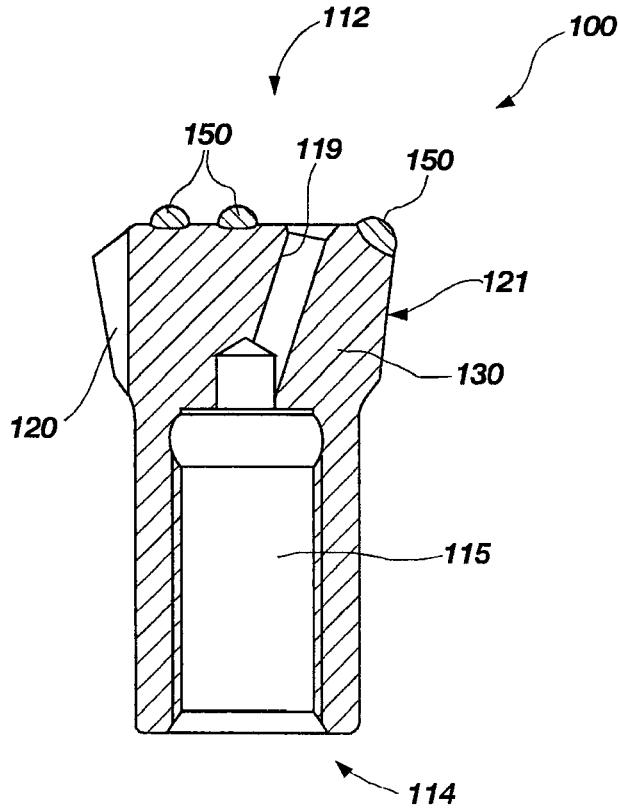
FIG. 13 shows a side cross-sectional view of the percussive subterranean drill bit shown in FIG. 12.

Thus, at least one polycrystalline diamond insert according to the present invention may be affixed to a so-called percussion bit. More particularly, FIG. 12 is a perspective view of a percussive subterranean drill bit 100 including at least one polycrystalline diamond insert 10 and FIG. 13 is a side cross-sectional view (taken along reference line A-A of FIG. 12) of the percussive subterranean drill bit 100. Drill bit 100 may be configured at a connection end 114 for connection into a drill string. Further, as shown in FIGS. 12 and 13, a percussion face 112 at a generally opposite end (relative to connection end 114) of drill bit 100 is provided with a plurality of inserts 150, arranged about percussion face 112 to effect drilling into a subterranean formation as bit 100 is rotated and axially oscillated in a borehole. At least one of inserts 150 may comprise a polycrystalline diamond insert 10, as described above, according to the present invention. In one embodiment, a plurality of extending blades 120 may extend or protrude from the bit body 130 of the subterranean drill bit 100, as known in the art. A gage surface 121 (also know as a gage pad) may extend upwardly from percussion face 112 (e.g., from each of the bit blades 120) and may be proximate to and may contact the sidewall of the borehole during drilling operation of bit 100. A plurality of channels or grooves 118 (also known as "junk slots") extend generally from percussion face 112 to provide a clearance area for formation and removal of chips formed by inserts 150. During use, a drilling fluid (e.g., compressed air, air and water mixtures, or other drilling fluids as known in the art) may be flowed through bore 115 and into at least one channel 119. As shown in FIG. 12, at least one channel 119 may terminate at the percussion face 112 at apertures 129.

Figure 14:
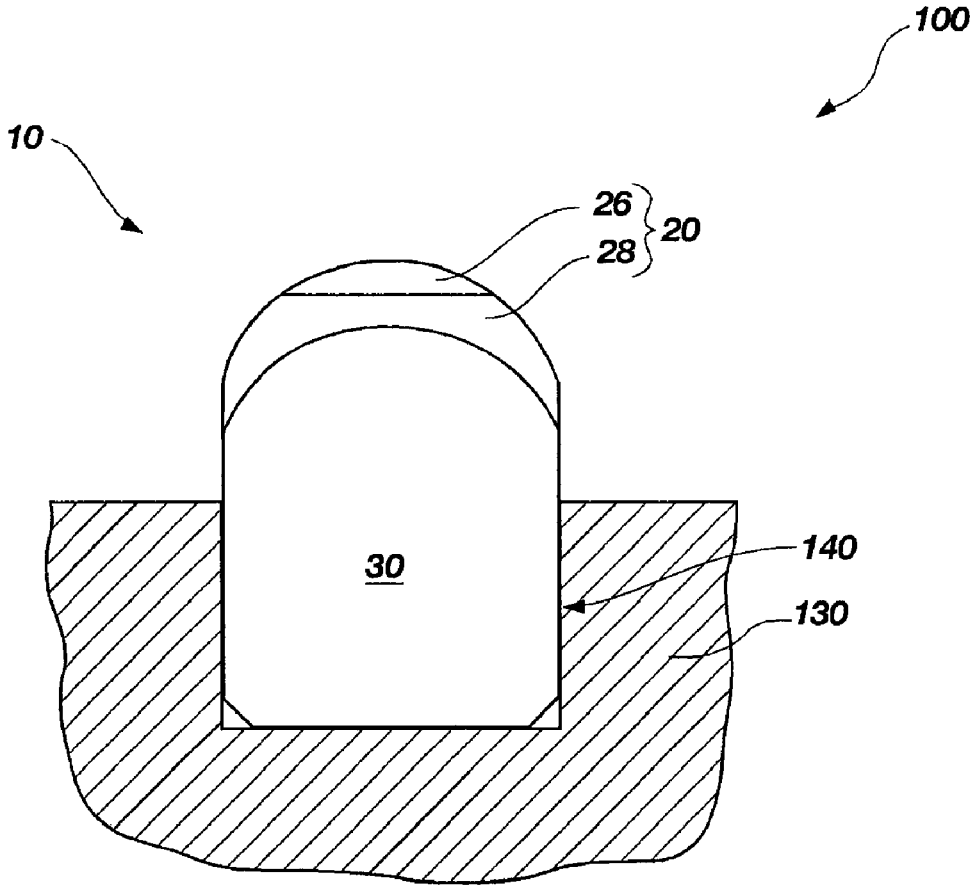
FIG. 14 shows a partial, side cross-sectional view of a polycrystalline diamond insert according to the present invention that is mounted to the percussive subterranean drill bit shown in FIGS. 12 and 13.

The plurality of inserts 150 may be affixed to (e.g., by press fitting, brazing, etc.) drill bit 100 and may be positioned within recesses formed in the bit body 130. Thus, such inserts 150 may provide the ability to actively remove formation material from a borehole. More particularly, FIG. 14 shows a schematic, partial side cross-sectional view of a polycrystalline diamond insert 10 positioned within a recess 140 defined within drill bit body 130 of drill bit 100.

Figure 15:
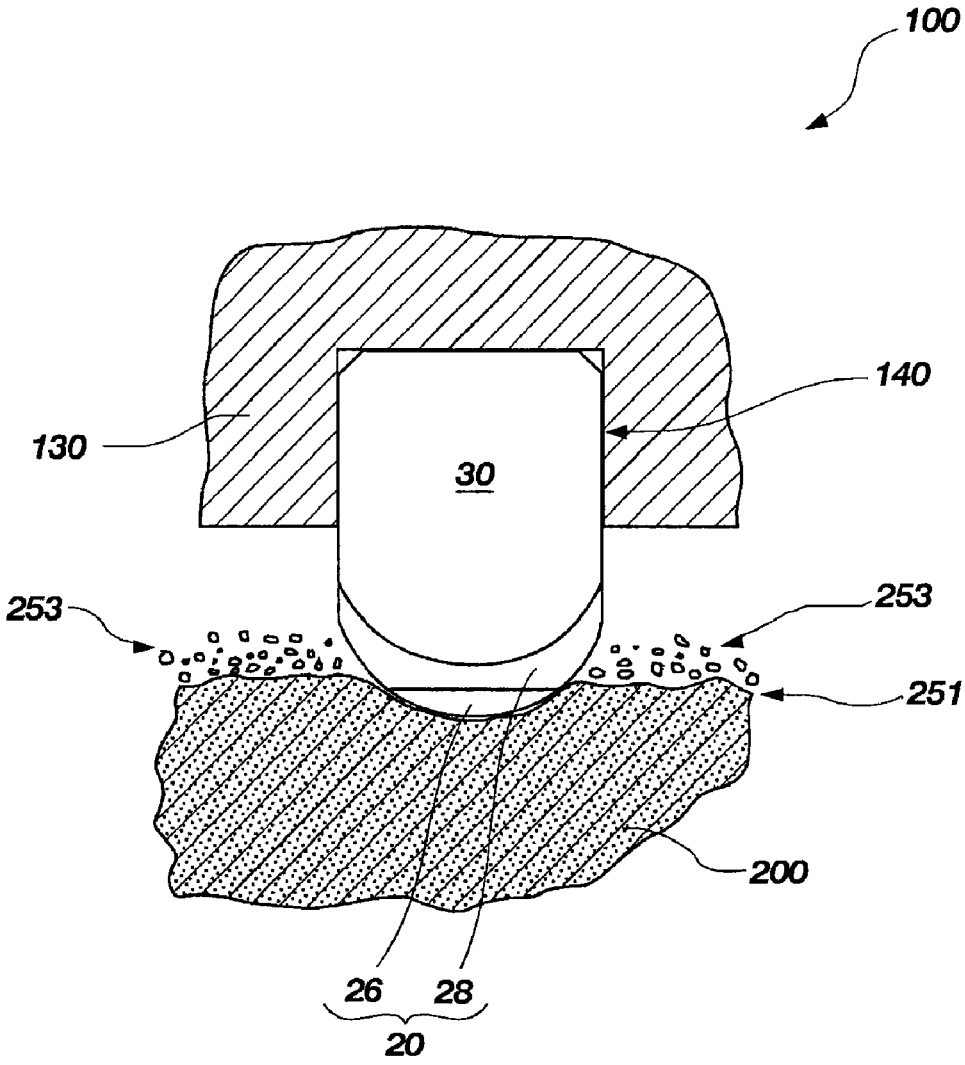
FIG. 15 shows a simplified, schematic side cross-sectional view of the polycrystalline diamond insert shown in FIG. 14 during operation.
Figure 16:
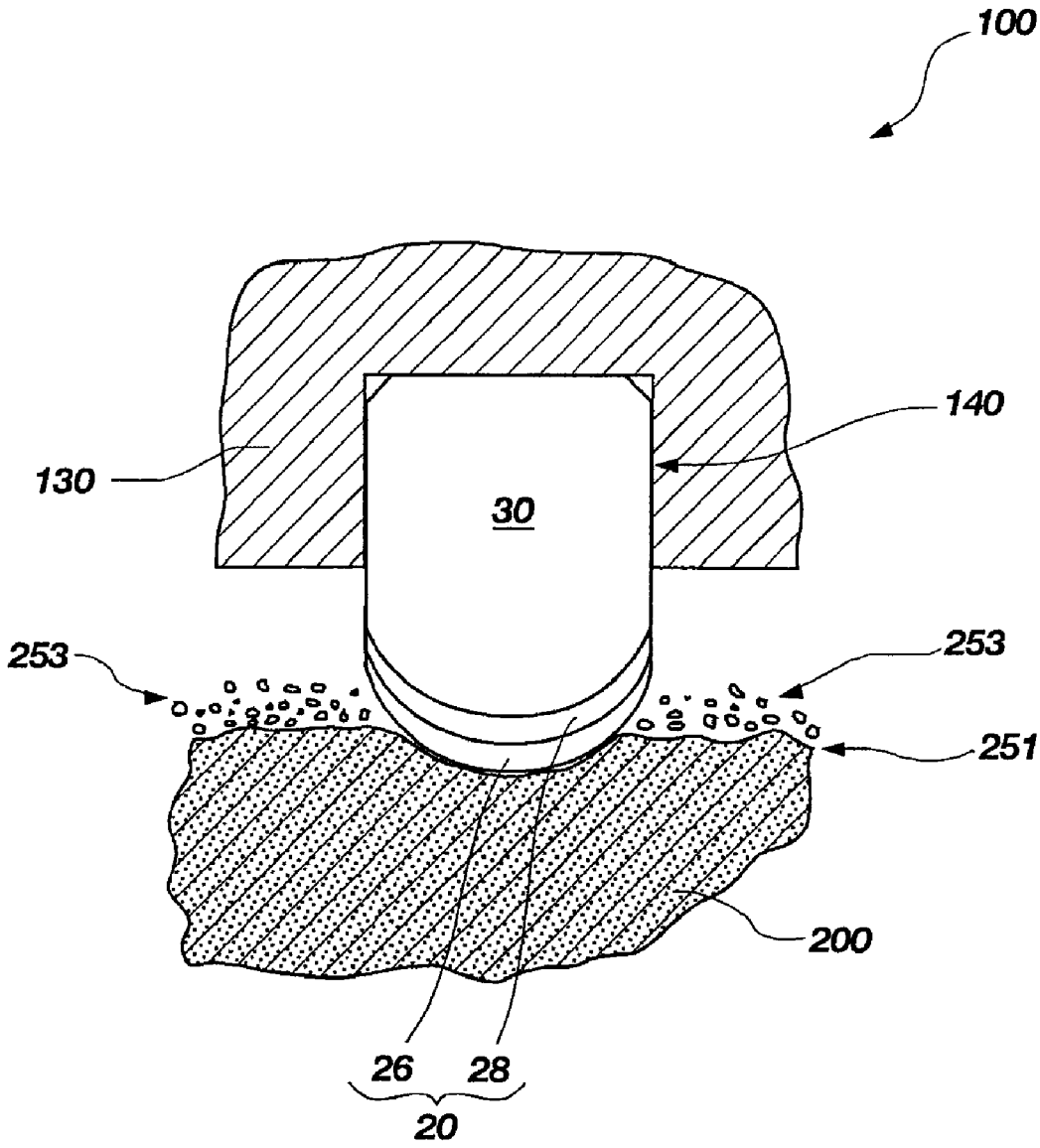
FIG. 16 shows a simplified, schematic side cross-sectional view of another embodiment of a polycrystalline diamond insert during operation.

In one embodiment, a polycrystalline diamond insert according to the present invention may engage or abut against a subterranean formation according to a direction of motion of a percussive drilling tool to which it is affixed. For example, FIG. 15 shows, in a simplified, partial, side cross-sectional view, the polycrystalline diamond insert 10 affixed to drill bit 100 shown in FIG. 14 during operation. More particularly, FIG. 15 shows polycrystalline diamond insert 10 positioned within a recess 140 and contacting subterranean formation 200. The geometry and dynamics of the cutting action of a percussion type subterranean drill bit are extremely complex. Generally, during use, at least a portion of the arcuate exterior surface 22 of the polycrystalline diamond layer 20 contacts a borehole surface 251 of the subterranean formation 200. As shown in FIG. 15, a portion of the arcuate exterior surface 22 of region 26 and at least a portion of the exterior surface 22 of region 28 may, substantially simultaneously, contact subterranean formation 200. The arcuate exterior surface 22 of the polycrystalline diamond insert 10 may cause fractures otherwise remove the material of the borehole surface 251 of the subterranean formation 200. Thus, the polycrystalline diamond insert 10 may remove material from the borehole surface 251 of the subterranean formation 200, to create fragments or chips 253 of the subterranean formation 200. In other embodiments, the portion of the arcuate exterior surface 22 of the polycrystalline diamond insert 10 that contacts the subterranean formation may be formed exclusively by the region from which catalyst has been at least partially removed. For example, FIG. 16 shows a simplified, partial, side cross-sectional view another embodiment of a polycrystalline diamond insert 10 during use. As shown in FIG. 16, a portion of the exterior surface 22 of region 26 may contact subterranean formation 200 to form fragments or chips 253.

Providing a polycrystalline diamond insert including a region from which catalyst has been removed may provide a more robust polycrystalline diamond insert. Further, the polycrystalline diamond layer may exhibit increased wear and thermal stability at a point on the polycrystalline diamond insert that is believed to contact the surface of a borehole most frequently. Thus, as discussed above, removal of at least a portion of a catalyst used in forming a polycrystalline diamond insert may be advantageous in relation to removing a portion of a subterranean formation than other types of conventional polycrystalline diamond inserts.

In addition, one of ordinary skill in the art will appreciate that polycrystalline diamond inserts according to the present invention may be equally useful in other drilling applications, without limitation. More generally, the present invention contemplates that the drill bits discussed above may represent any number of earth-boring tools or drilling tools, including, for example, core bits, roller-cone bits, fixed-cutter bits, eccentric bits, bicenter bits, reamers, reamer wings, or any other downhole tool for forming or enlarging a borehole that includes at least one polycrystalline diamond insert, without limitation.

Although polycrystalline diamond inserts and drilling tools described above have been discussed in the context of subterranean drilling equipment and applications, it should be understood that such polycrystalline diamond inserts and systems are not limited to such use and could be used for varied applications as known in the art, without limitation. Thus, such polycrystalline diamond inserts are not limited to use with subterranean drilling systems and may be used in the context of any mechanical system including at least one polycrystalline diamond insert. In addition, while certain embodiments and details have been included herein for purposes of illustrating aspects of the instant disclosure, it will be apparent to those skilled in the art that various changes in the systems, apparatuses, and methods disclosed herein may be made without departing from the scope of the instant disclosure, which is defined, at least in part, in the appended claims. The words "including" and "having," as used herein including the claims, shall have the same meaning as the word "comprising."

What is claimed is:

1. A polycrystalline diamond insert comprising:

a polycrystalline diamond layer affixed to a substrate, the polycrystalline diamond layer comprising:

a first region including a catalyst used for forming the polycrystalline diamond layer, the first region extending partially along a side of the polycrystalline diamond insert;

a second region from which the catalyst is at least partially removed, the second region extending along a top and the side of the polycrystalline diamond insert, the second region having a first thickness at a first location and a second thickness at a second location;

an arcuate exterior surface at least partially defined by the second region.

2. The polycrystalline diamond insert of claim 1, wherein at least a portion of the arcuate exterior surface is structured for percussively contacting a subterranean formation.

3. The polycrystalline diamond insert of claim 1, wherein the catalyst used for forming the polycrystalline diamond layer is substantially removed from the second region of the polycrystalline diamond layer.

4. The polycrystalline diamond insert of claim 1, wherein the arcuate exterior surface is substantially spherical or substantially hemispherical.

5. The polycrystalline diamond insert of claim 1, wherein the first region has a first thickness at a first location and a second thickness at a second location.

6. A polycrystalline diamond insert comprising:

a polycrystalline diamond layer affixed to a substrate and defining a top surface and at least a portion of a side surface of the polycrystalline diamond insert;

wherein at least a portion of a catalyst used for forming the polycrystalline diamond layer is substantially removed from a region of the polycrystalline diamond layer;

wherein the at least partially leached layer region exhibits a first thickness at a first location and a second thickness at a second location;

wherein the polycrystalline diamond layer includes a convex exterior surface for contacting a subterranean formation.

7. The polycrystalline diamond insert of claim 6, wherein at least a portion of the convex exterior surface is structured for percussively contacting a subterranean formation.

8. The polycrystalline diamond insert of claim 6, wherein the at least partially leached region extends partially along the side surface.

9. The polycrystalline diamond insert of claim 6, wherein the convex exterior surface is substantially spherical or substantially hemispherical.

10. The polycrystalline diamond insert of claim 6, wherein an unleached portion of the polycrystalline diamond layer that includes the catalyst extends at least partially along the side surface.

11. The polycrystalline diamond insert of claim 6, wherein an unleached portion of the polycrystalline diamond layer exhibits a first thickness at a first location and a second thickness at a second location.

12. A percussion drill bit for forming a borehole in a subterranean formation, comprising:

a bit body comprising a leading end structured for facilitating formation of a subterranean formation by percussive interaction with the subterranean formation;

at least one polycrystalline diamond insert coupled to the leading end of the bit body, the at least one polycrystalline diamond insert comprising:

a polycrystalline diamond layer affixed to a substrate, the polycrystalline diamond layer comprising:

a first region including a catalyst used for forming the polycrystalline diamond layer, the first region extending partially along at least a portion of a side of the polycrystalline diamond insert;

a second region from which the catalyst is at least partially removed, the second region extending along a top and at least a portion of the side of the polycrystalline diamond insert, the second region having a first thickness at a first location and a second thickness at a second location;

an arcuate exterior surface at least partially defined by the second region.

13. The percussion drill bit of claim 12, wherein the at least one polycrystalline diamond insert is brazed to the bit body or is press-fit within a recess formed in the bit body.

14. The percussion drill bit of claim 12, wherein the second region exhibits a first thickness at a first location and a second thickness at a second location.

15. The percussion drill bit of claim 12, wherein the catalyst used for forming the polycrystalline diamond layer is substantially removed from the second region of the polycrystalline diamond layer.

16. The percussion drill bit of claim 12, wherein the arcuate exterior surface is substantially spherical or substantially hemispherical.

17. The percussion drill bit of claim 12, wherein the first region exhibits a first thickness at a first location and a second thickness at a second location.

* * * * *